United States Patent [19]

Müller et al.

[11] 4,289,725

[45] Sep. 15, 1981

[54] MATERIAL WEB FOR THE MANUFACTURE OF FILTER RODS FOR TOBACCO PRODUCTS AND APPARATUS AND PROCESS FOR PRODUCING SUCH WEB

[75] Inventors: Paul A. Müller, Triesenberg, Liechtenstein; Hans Muster, Greifensee, Switzerland

[73] Assignee: Celfil Company Establishment, Vaduz, Liechtenstein

[21] Appl. No.: 159,281

[22] Filed: Jun. 13, 1980

Related U.S. Application Data

[63] Continuation of Ser. No. 844,389, Oct. 21, 1977, abandoned.

[30] Foreign Application Priority Data

Aug. 11, 1977 [CH] Switzerland ..... 9888/77

[51] Int. Cl.[3] ..... B31F 1/22; B21F 1/36

[52] U.S. Cl. ..... 264/287

[58] Field of Search ..... 264/287

[56] References Cited

U.S. PATENT DOCUMENTS

| | | | |
|---|---|---|---|
| 2,055,877 | 9/1936 | Palmer | 264/287 X |
| 2,169,505 | 8/1939 | Sherman | 264/287 |
| 3,383,449 | 5/1968 | Muller | 264/287 |
| 3,849,526 | 11/1974 | Muller | 264/287 X |

*Primary Examiner*—Thomas P. Pavelko

*Attorney, Agent, or Firm*—Cushman, Darby & Cushman

[57] ABSTRACT

The invention relates to a longitudinally creped paper web for use in the manufacture of filter rods. In order to improve the filtering capacity and resistance to flow therethrough without weakening filter plugs formed from the web in respect of resistance to radial crushing the longitudinally creped web is provided wth linear indentations transversely thereof which are sufficiently closely spaced one from the other longitudinally of the web to provide consistency in draw of short length sections cut from filter plugs made from the web. The invention also relates to the process and apparatus for forming such a filter web using co-operating spaced rollers for forming controlled linear compression zones extending transversely of the web, at least one of these two rollers being provided with ribs extending at least approximately axially of the roll. A drive to the two rollers is synchronized so that the surface speed of both the rollers is at the same speed as the speed of advance of the web being treated thereby. The treated web may either be formed into a roll or coil for storage and subsequent use or may be fed directly to a tow machine in which it is formed at once into filter plugs in the conventional manner. The invention also relates to filter plugs of which the filling comprises the gathered together material web.

8 Claims, 21 Drawing Figures

Fig. 1
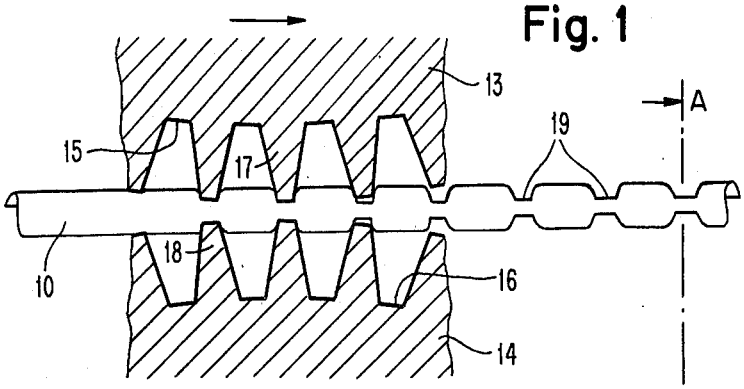
Fig. 2
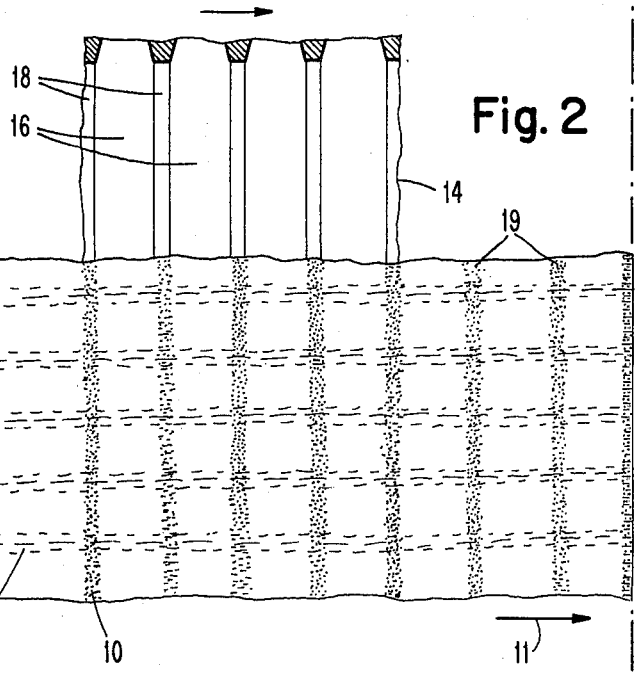
Fig. 3
Fig. 4
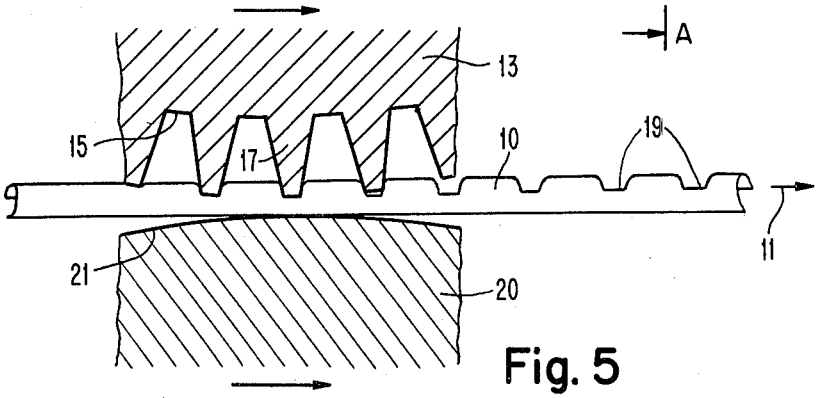
Fig. 5

11

11

Fig. 16
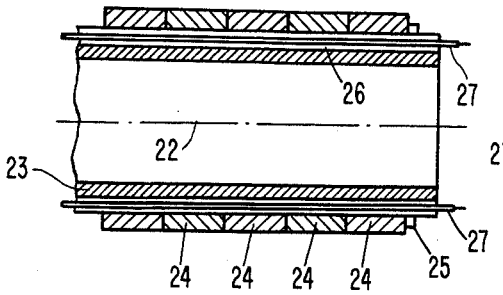
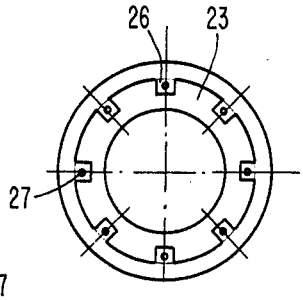
Fig. 17
Fig. 18
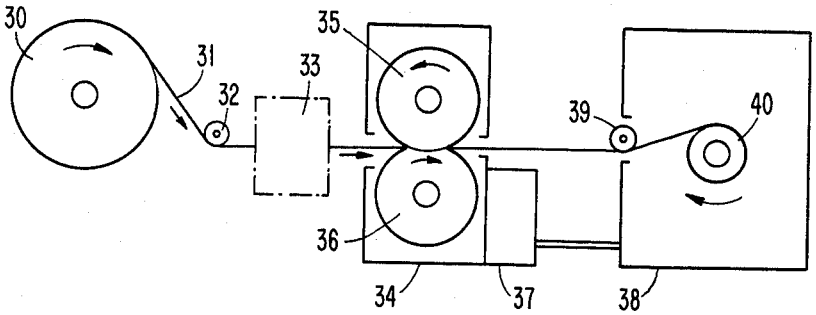
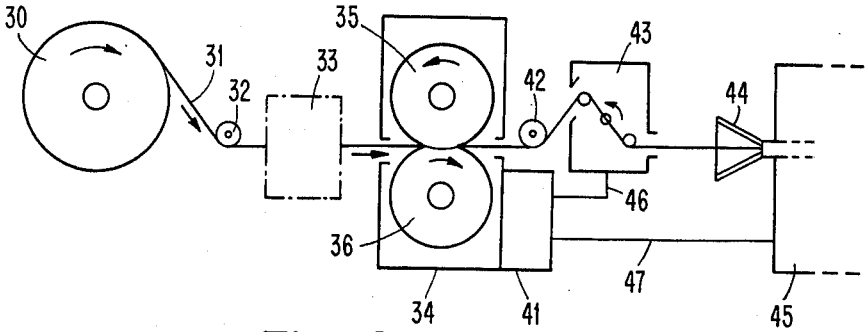
Fig. 19

Fig. 20
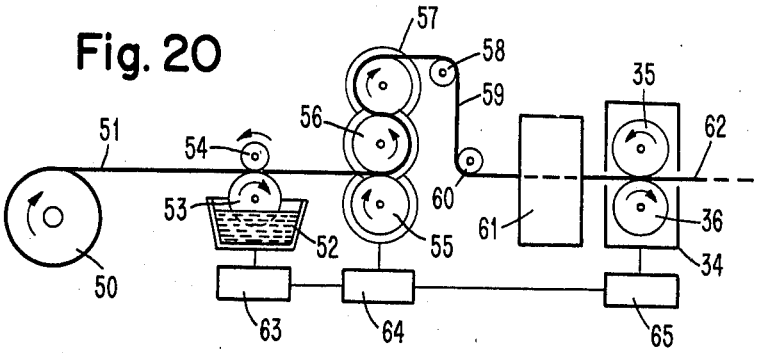
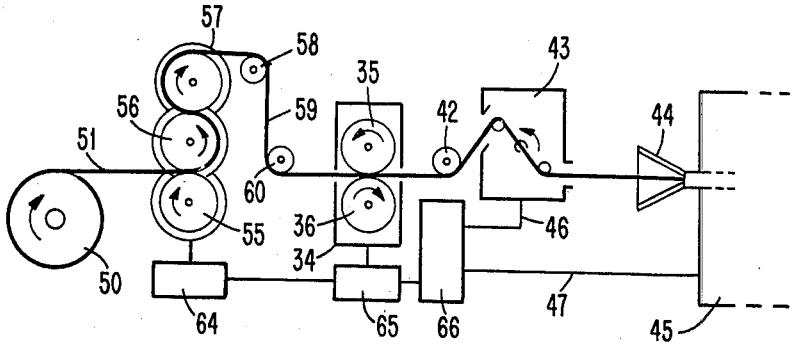
Fig. 21

MATERIAL WEB FOR THE MANUFACTURE OF FILTER RODS FOR TOBACCO PRODUCTS AND APPARATUS AND PROCESS FOR PRODUCING SUCH WEB

This is a continuation of application Ser. No. 844,389 filed Oct. 21, 1977 now abandoned.

The present invention relates to a fibre-containing material web, especially a paper web, for the manufacture of filter rods which can be subdivided into filter plugs for tobacco products, the web being provided with a multiplicity of zones which run in the longitudinal direction and have a highly fibrillated structure and/or unconnected crack-like orifices and also with zones, located between the former zones, having a denser structure and/or rib-like deformations, but the cohesion of the material web being preserved. Material webs of this type, and especially paper webs, are already extensively used for the manufacture of filter plugs for cigarettes and may be manufactured by the processes of U.S. Pat. Nos. 2,931,748, 2,940,891, 2,995,481, 3,161,557, 3,179,024, 3,226,280, 3,383,449. Filter rods produced from such webs using the conventional tow machines are satisfactory for most purposes in respect of their draw resistance and the separation effect, which is proportional to the latter, in respect of undesired substances in tobacco smoke, and the mechanical strength of the filter sticks is also adequate. For some types of filter plugs demanded by the cigarette manufacturers, it is necessary, in order to ensure the desired, considerably higher draw resistance, to pass the particular paper webs, after drying, between a pair of so-called knurling rollers, the surfaces of which are provided with pyramid-shaped points, these rollers destroying again, in particular, the denser zones having the rib-like deformations in the paper web. The even greater fibrillation achieved as a result does indeed give the desired higher draw resistance but at the same time effects a reduction in the mechanical strength of the particular filter sticks. Another method for increasing the draw resistance of such paper webs is described in U.S. Pat. No. 3,383,852 and is based on the replacement of the said knurling rollers by a pair of rollers having a smooth surface which, in particular, results in the rib-like deformations being pressed together and enables the draw resistance to be increased; however, this is again at the expense of a reduced mechanical strength of the filter stricks produced.

According to one aspect of the present invention there is provided a fibre-containing material web for the manufacture of filter rods which can be subdivided into filter plugs for tobacco products, the web having a rib-like structure comprising a multiplicity of first zones which run longitudinally of the web and have a highly fibrillated structure and second zones, located between the first zones, having a denser structure than the first zones, the material web also having impressed therein a design consisting of closely adjacent impressions which are in the form of lines of strokes and extend transversely over at least part of the longitudinal zones to provide the rib-like structure running in the longitudinal direction with consecutive indentations spaced longitudinally of the web.

Another aspect of the present invention provides a process for the manufacture of a material web wherein a material web provided with a multiplicity of zones of different alternating dense and less dense structures running in the longitudinal direction is moved in the said longitudinal direction and, at successive intervals, is pressed together, for a short time in each case and only in linear regions running transversely to the material web, a multiplicity of consecutive permanent indentations being produced at least on the denser longitudinal structures with the longitudinal structures being retained undestroyed between the consecutive indentations.

A further aspect of the invention provides apparatus for the manufacture of a material web suitable for use in the manufacture of filter rods, such apparatus containing a holding frame with two rollers, the axes of which are arranged parallel to one another, means for adjusting the position of the first roller in respect of its distance from the second roller, at least one of the two rollers having, on its surface, projecting ribs which form a uniform design in the form of strokes that run at least substantially parallel to the axis of the roller, and a controllable drive for the two rollers whereby the two rollers are rotatable with equal surface speeds.

A fourth aspect of the invention provides a filter rod for filters for tobacco products, which comprises a packing of a paper web which has been gathered together transversely to its longitudinal direction and has a multiplicity of zones which run in the longitudinal direction and have a highly fibrillic structure and/or unconnected crack-like orifices, and also zones, located between the former zones, having a denser structure and/or rib-like deformations, which packing additionally has successive closely adjacent impressions and indentations in the axial direction, these impressions and indentations extending transversely to the longitudinal zones.

The present invention is explained in more detail below in various illustrative embodiments, with the aid of the accompanying drawings, in which:

FIG. 1 is a schematic representation of a longitudinal section of part of an illustrative embodiment of equipment provided with embossing rollers according to the teachings of the invention;

FIG. 2 is a schematic horizontal projection of the equipment according to FIG. 1 without the upper roller;

FIGS. 3 and 4 are each a schematic cross-section through a paper web, before entry into the equipment according to FIGS. 1 and 2 and, respectively, along the plane A—A after the web has left the equipment;

FIG. 5 is a schematic cross-section through a further illustrative embodiment of the equipment;

Figure 6:
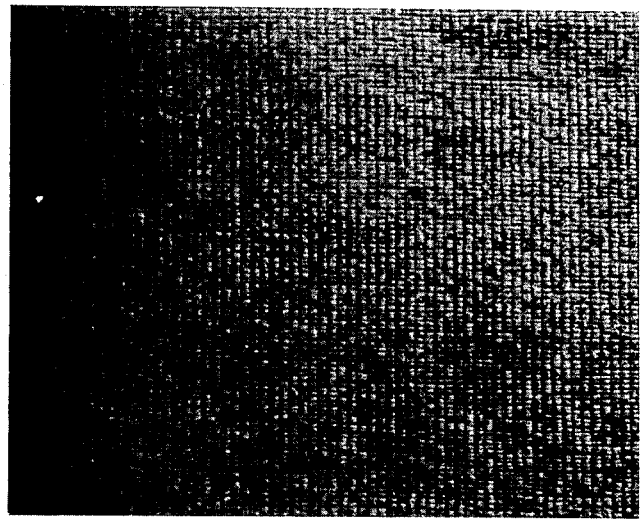
FIG. 6 is a photograph of the surface of an illustrative embodiment of the paper web according to the invention.

FIGS. 11–15 each show a view of the surface of different illustrative embodiments of embossing rollers for the equipment of FIG. 1;

FIGS. 16 and 17 show respectively an axial longitudinal section and the side view of an illustrative embodiment of the embossing rollers;

FIG. 18 is a schematic representation of an illustrative embodiment of an installation for the manufacture of a roll of paper web according to the invention;

FIG. 19 is a schematic representation of an illustrative embodiment of an installation for the manufacture of the paper web according to the invention and processing it into filter rods;

FIG. 20 is a schematic representation of an illustrative embodiment of an installation for the manufacture of a paper web according to the invention from a roll of plain paper; and FIG. 21 is a schematic representation of an illustrative embodiment of an installation for the manufacture of a paper web according to the invention from a roll of plain paper and processing the web to form filter rods.

The principle of the process for the production of the present material web is initially illustrated in more detail with the aid of FIGS. 1 to 4. It is assumed that a paper web 10 of a known type is available which has a multiplicity of rib-like deformations 12, which run parallel in the longitudinal direction, and thus in the direction of movement 11, and are of a denser fibre structure, and also longitudinal zones, located between the former zones, having a highly fibrillated structure and a multiplicity of unconnected longitudinal slits. Paper webs of this type which are, for example, 15 to 30 cm wide are already used in considerable quantities for the manufacture of filter rods in so-called tow machines, in which the paper web which passes through is gathered together in the transverse direction, covered with smooth paper and shaped to give a continuous cylindrical tow of, for example, 8 mm diameter, from which the filter rods, for example 80 mm in length, are then manufactured by subdividing. These filter rods are subsequently fed to one of the conventional cigarette machines where they are further subdivided into filter plugs and attached to a tube of tobacco, which has already been covered, by means of a the so-called tip strip, in order to produce filter cigarettes.

As shown in the Figures, this paper web 10 is first fed to equipment which, according to FIGS. 1 and 2, essentially consists of the two embossing rollers 13 and 14 which are arranged with their axes parallel and with the distance between the axes being adjustable. In the illustrative embodiment shown in FIGS. 1 and 2, the two rollers have projecting ribs 17 and 18 on their surfaces 15 and 16 respectively, these ribs extending around the entire surface of the rollers and running parallel to the axes of the rollers. The two rollers 13 and 14 have a cross-section with projecting ribs that are absolutely identical and the rollers are driven together in such a way that they rotate at the same surface speed. They are adjusted relative to one another so that the tips of the ribs of the upper roller 13 and of the ribs of the lower roller 14 are precisely opposite one another in the gap between the two rollers. The paper web 10 is moved through this gap and for this reason the distance between the rollers 13 and 14 is adjusted so that the fore-parts of the ribs 17 and 18, which are opposite one another, do not come into contact. A distance of about 0.1–0.2 mm between opposite ribs 17 and 18 must be maintained.

As indicated schematically in FIGS. 1 and 2, the paper web 10, and especially its longitudinal ribs 12, are provided, on passing through the gap between the rollers 13 and 14, with closely adjacent impressions 19 which, in this case, extend transversely over all of the longitudinal zones and, in particular, give corresponding indentations in the longitudinal ribs 12. Whilst the paper web 10 still has the cross-section indicated schematically in FIG. 3 and a total thickness between the upper and lower longitudinal ribs of, for example, 0.8 mm when it enters into the gap between the pair of rollers 13 and 14, the paper web has been pressed virtually completely flat along the impressions 19, as is shown schematically in FIG. 4 along the cutting plane A–A. Of course, the cross-section of the paper web remains virtually unchanged in the spaces between adjacent impressions 19 and thus corresponds approximately to FIG. 3. In the present illustrative embodiment, the rollers 13 and 14 have diameters of about 180 mm, and the ribs 17 and 18 respectively, which run parallel to the central axis of each roller, project about 3 mm beyond the particular surface 15 or 16 respectively of the roller and have the cross-section of an equilateral triangle and a distance from centre line to centre line of about 2 mm. In order to ensure accurate true running after the mechanical production of the rollers, the surfaces of the rollers are ground, so that the tips of the ribs 17 and 18 are about 0.2 mm wide.

In the illustrative embodiment of the equipment according to FIGS. 1 and 2, it must be ensured that, in each case, the fore-parts of the ribs 17 and 18 are precisely opposite one another in the gap between the two rollers 13 and 14 and this requires high precision during manufacture of the rollers and in respect of the drive and adjustment thereof. An illustrative embodiment of the equipment for the manufacture of the present paper web which is less demanding in this respect and is preferred is shown in FIG. 5. In this case an upper roller 13 having ribs 17, projecting above the surface 15, of the same type of construction as in the illustrative embodiment according to FIG. 1 is used. However, this roller 13, provided with ribs, is opposite a roller 20 which has a smoothly ground surface 21. The gap between the two rollers, or between the particular rib 17 and the smooth surface 21, can be adjusted in this case also and is preferably set to about 0.15 to 0.2 mm. The paper web 10, which passes through, is provided with impressions 19 in this case also, but these impressions are produced only by the upper roller 13 and its ribs 17. When the two rollers 13 and 20 are correctly set to a gap width of 0.15 to 0.20 mm, it is, however, possible to achieve virtually the same advantageous results, which are explained in even more detail below, as in the case of a paper web which is provided with such indentations on the upper and lower side at the same time, using equipment according to FIG. 1.

As already mentioned above, paper webs which have rib-like deformations running in the longitudinal direction and zones, located between the latter, having a multiplicity of unconnected crack-like orifices are already used for the manufacture of filter sticks for tobacco products. Paper webs which have such longitudinal ribs at intervals of about 1 mm have proved particularly appropriate for this purpose. If a paper web of this type is provided, by means of equipment according to FIG. 5, with impressions, in the form of strokes, which run transversely to the longitudinal ribs and follow one another at intervals of approximately 2 mm, this gives the paper web shown in FIG. 6. The unconnected orifices which run in the longitudinal direction 11 and the longitudinal ribs extending between the latter can clearly be seen, as can the impressions which run transversely thereto, that is to say vertically to the direction of the arrow 11. The resulting structure can be seen even more clearly from FIG. 7, which is an eight fold enlargement of FIG. 6. In these two photographs, the white paper web was, in each case, placed on a black background and photographed from above in reflected light, so that the blank portions in each case represent orifices in the highly fibrillated paper web. However, despite the existing fibrillations, which is necessary for the desired strong filter effect, a paper web of this type has considerable strength in the longitudinal direction 11, which is necessary if it is to be processed in tow machines to manufacture filter rods. Despite the multiplicity of unconnected longitudinal slits, however, the transverse cohesion of the paper webs is also ensured, which is also important for processing in a tow machine.

Figure 7:
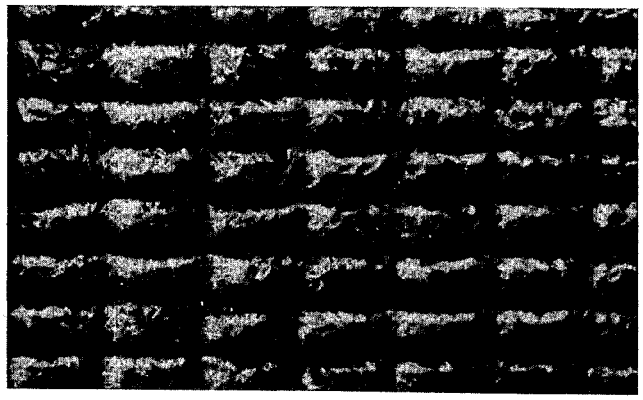
FIG. 7 is an eight-fold enlargement of the paper web shown in FIG. 6 on a scale of 8:1.
Figure 8:
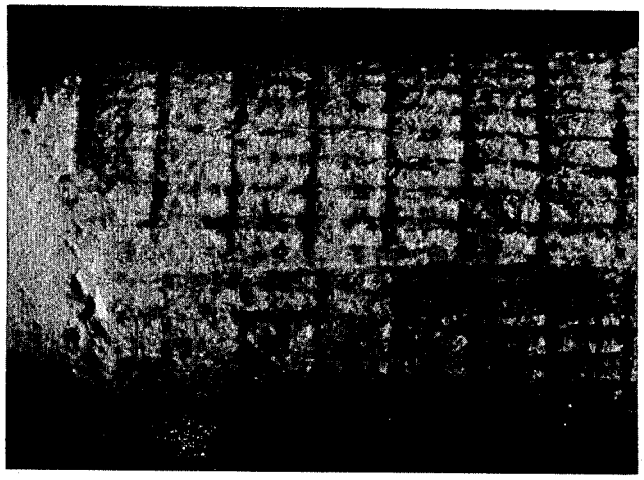
FIG. 8 is a photograph of a filter rod formed from a paper web according to FIGS. 6 and 7, the covering of the filter rod being partly removed.

It must, however, be pointed out that the paper web according to FIGS. 6 and 7 has, despite the existing fibrillation, which is important for a good filter action, a stable structure which is retained substantially unchanged even after the deliberate gathering together in the transverse direction on entry into a tow machine for the manufacture of filter rods. This can be seen, for example, from FIG. 8 which shows a photograph of a filter rod manufactured from a paper web according to FIGS. 6 and 7; for the photograph, the outer covering of the cylindrical filter rod of 8 mm diameter was cut away in order to render the structure of the packing visible. Despite the fact that the paper web has been gathered together in an irregular manner and deliberately transversely to its longitudinal direction, the zones running in the longitudinal direction, which have a highly fibrillated structure, and unconnected crack-like orifices can be seen. Moreover, the packing shows a multiplicity of additional impressions and indentations which follow one another in the axial direction and are closely adjacent and which run transversely to the longitudinal zones. As a result of these indentations, a multiplicity of transverse connections between the individual channels running in the longitudinal direction for the passage of smoke are thus provided when cigarette filters of this type are used. At the same time, however, the streams of smoke in the individual longitudinal channels are slowed down and deflected by the walls of the indentations and this results in an increase in the so-called draw resistance of the filter rods, which is advantageous, as will also be explained further below.

In addition to this desired increase in the draw resistance, the indentations, however, also effect a stiffening of the paper web in the transverse direction, caused by the rib-like deformations 12, which run in the longitudinal direction, being pressed together, as is shown schematically in FIG. 4. This stiffening in the transverse direction is also desirable and, in the packing of the filter sticks, effects a certain radial pressure outwards and thus increases the mechanical strength of these sticks against compression from the outside.

It will initially be demonstrated that a paper web treated in accordance with the present process gives a technical advance in respect of the draw resistance which can be achieved in filter rods. It is to be taken into account that, in the present range of draw resistances, the increase therein is synonymous with an increase in the retention, that is to say the separation, of undesirable smoke constituents of the tobacco smoke.

EXAMPLES

The measurements given below were carried out on filter rods which had all been manufactured from longitudinally grooved and fibrillated paper webs made from a smooth raw paper from Messrs. TENERO/Switzerland on machines available commercially under the name DICO(®) at a speed of about 150–200 m/minute. The draw resistance of the filter rods was measured in a commercially available apparatus which it is not necessary to describe since it is only a comparison of the results which is important here.

A and B—So-called "slightly creped" paper webs were manufactured from a raw paper weighing about 31 grams per $m^2$ and of different widths, and filter rods 8.0 mm in diameter and 84 mm in length were produced from these webs on a tow machine of conventional construction. The draw resistance in mm of WC (water column) was measured for 100 filter rods in each case, and the average value was derived from these measurements and plotted in the diagram of FIG. 9 as a function of the width of the raw paper used. In the case of the curve designated A, while the paper webs were passed through a station according to FIG. 5, the gap between the rollers 13 and 20 was set so wide that the ribs 17 did not come into contact with the paper web. On the other hand, in the case of the curve designated B, the gap between the ribs 17 of the roller 13 and the ribs 18 of the roller 14 was in each case reduced to about 0.15 mm, that is to say the paper web was provided, in accordance with the present process, with a multiplicity of impressions and indentations running transversely. However, the particular setting of the machine in respect of the speed, and depth of crepe and the like was retained unchanged.

C and D—In this case highly creped paper webs, that is to say paper webs provided with rib-like deformations as deep as possible and highly fibrillated longitudinal zones between the deformations, obtained from a raw paper weighing 35 grams/$m^2$ and of different widths, were used in order to manufacture $8.1 \times 66$ mm filter rods. The average value of the draw resistance of 100 filter rods in each case was plotted in the diagram. Curve C shows this draw resistance as a function of the width of the uncreped paper for filter rods made from paper webs without embossed indentations and, on the other hand, D shows the corresponding values for filter rods made from paper webs having such indentations.

It can be seen from a comparison from curves A and B that the treatment of the paper web in accordance with the present process in an equipment described above with the aid of FIG. 5 results in an increase in the draw resistance, corresponding to the vertical distance between curve B and curve A. This increase in the draw resistance is about 60%, relative to curve A. In the case of the filter rods corresponding to curve B, thus, an approximately 60% greater retention of the undesired components of the smoke can be expected, after the filter rods have been sub-divided into filter plugs for cigarettes, than in the case of the filter rods or filter plugs corresponding to curve A.

Figure 9:
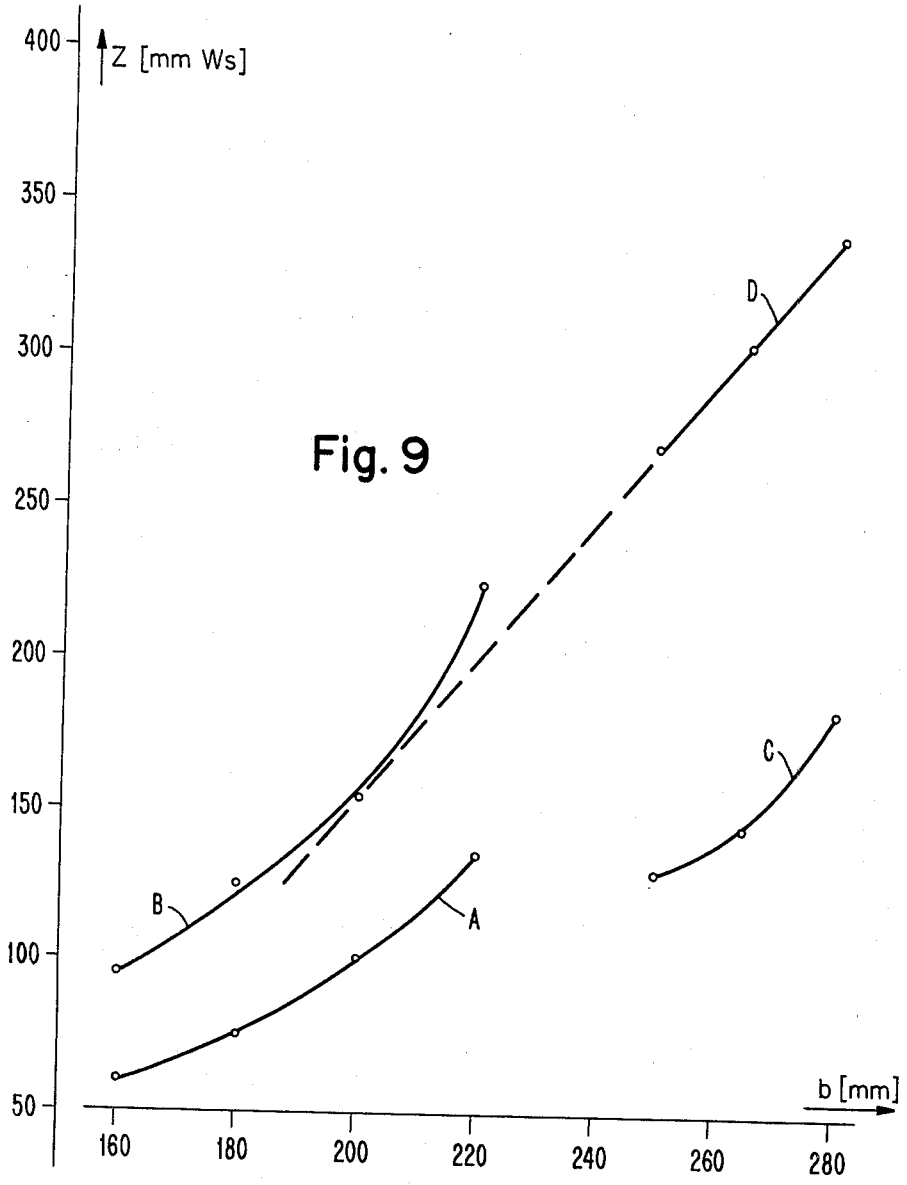
FIG. 9 is a diagram of the draw resistance as a function of the breadth of raw paper web used for various filter rods.

The advantages of the paper webs treated in accordance with the present process can also be demonstrated from curves A and B of FIG. 9 by the horizontal distance between the two. If, for example, filter rods having a draw resistance of about 135 mm of WC are to be manufactured, a width of raw paper of 220 mm is usually required for this purpose according to curve A.

When the present process is used, on the other hand, a width of raw paper of about 190 mm suffices, as curve B shows, to ensure the same draw resistance of the filter rods. The saving of a 30 mm width of raw paper, or of about 13% compared with the previous consumption, is an appreciable lowering in the cost of such filter rods since the costs thereof are essentially determined by the consumption of raw paper.

A comparison of curves A and B thus shows the considerable superiority of the paper webs treated in accordance with the present process for the manufacture of 8.0×84 mm filter rods having a relatively low draw resistance. Filter rods of this type are extensively used in the manufacture of filter cigarettes. However, the paper webs treated in accordance with the present process can also advantageously be used in the production of filter rods which have to meet considerably greater demands, as curves C and D in the diagram according to FIG. 9 show.

These curves C and D relate to filter rods 8.1×66 mm in size, for which, despite the shorter length, substantially higher draw resistances of about 150 mm of WC are required than in the case of the 8.0×84 mm filter rods of curves A and B. Accordingly, wider raw paper webs must be used and a deeper longitudinal grooving with as high as possible a degree of fibrillation of the paper web must be provided in order, according to curve C, to obtain a draw resistance of the magnitude demanded without the use of the present process. However, if the paper webs for filter rods according to curve C are additionally provided, in accordance with the presnt process, with impressions running transversely, the draw resistances according to curve D are obtained. In this case, the increase in the draw resistance is about 100% compared with curve C, that is to say it is much greater than in the case of Example A-B above and, of course, this is due to the fact that, with the more strongly pronounced rib-like deformations of the longitudinally grooved paper web in this case, the indentations running transversely thereto also change the paper structure to a greatr degree than is the case with the less deeply longitudinally grooved and deformed paper webs of Example A-B. The width of raw paper which would have to be provided in order to manufacture filter rods having a draw resistance of about 150 mm of WC is, as shown by the prolongation of curve D, drawn as a broken line, only about 200 mm when the present process is used, compared with the width of about 270 mm required hitherto according to curve C. The saving in raw paper would, in this case, then be about 26%, that is to say twice as great as in the case of Example A-B.

As already mentioned above, a significant factor is that, in the case of all measures for increasing the draw resistance of filter rods, too severe an impairment of the mechanical strength thereof towards a radial pressure exerted vertically to the axis of the filter rod is highly undesirable. This mechanical strength or hardness can be measured with commercially available devices, such as are described, for example, in a publication by J. Flesselles in "Beiträge zur Tabakforschung", page 528–538, Number 8, Volume 3, 1966. An explanation is not required here since, in the present context, it is only the comparison of different values of the depth of penetration of a loaded stamp in the radial direction into such filter rods which is of interest.

Figure 10:
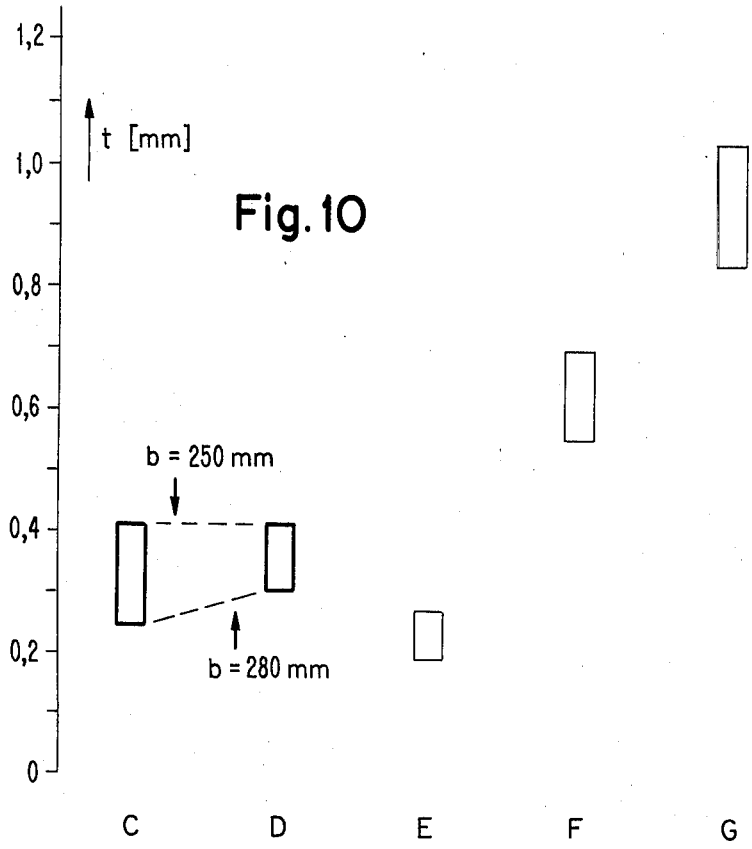
FIG. 10 is a diagram of the depth of penetration when hardness measurements are carried out on various filter rods.

In the diagram of FIG. 10, this depth of penetration is plotted for the filter rods according to Examples C and D described above. This depth of penetration is the less the harder the packing of the filter rods. Accordingly, the depth of penetration for filter rods according to Example C produced from 280 mm wide raw paper webs is less than that for filter rods produced from 250 mm wide raw paper webs. A hardness corresponding to depths of penetration of less than about 0.4 mm is regarded as acceptable for the further processing of the filter rods. As FIG. 10 shows, the depth of penetration is virtually unchanged when paper webs treated in accordance with the present process are used for the manufacture of the filter rods according to Example D, despite the fact that, as explained above, the draw resistance of these filter rods has been increased by about 100%, compared with that according to Example C. Apparently, the indentations running transversely to the longitudinal axis of the filter effect an increased rigidity of the packing in the radial direction, especially in the longitudinal ribs of the paper web.

The advantage of a constant hardness despite an increase in the draw resistance, which is achieved with filter rods manufactured with paper webs treated in accordance with the present process, can be particularly appreciated if the negative influence on the hardness of the rods which results from the conventional measures for increasing the draw resistance is taken into account for comparison. Such comparison measurements E, F and G under the same above mentioned test conditions as for the hardness measurements according to C and D are plotted in FIG. 9. 8.1×66 mm filter rods were measured and in each case these were manufactured from paper webs produced from 290 mm wide raw paper webs and having extensive creping, that is to say grooving as deep as possible.

Hardness measurement E: Without additional measures to increase the draw resistance, the filter rods showed a draw resistance of 120 to 130 mm of WC and a depth of penetration of 0.19 to 0.27 mm, as plotted in the diagram of FIG. 10.

Hardness measurement F: The same longitudinally grooved paper web as in Example E was additionally fed, after longitudinal grooving had been effected, in the dry state through a so-called knurling station where it passed between two rollers which are pressed together and rotated about horizontal axes, the surface of the rollers being provided with a dense knurling consisting of a multiplicity of pyramidshaped protuberances. This knurling station has already been described in more detail in the U.S. Pat. Nos. 2,995,481, 3,179,024 and is a known means of effecting further fibrillation of the paper webs in order to increase the draw resistance of the filter rods manufactured therefrom. It is possible, by this means, to manufacture filter rods having a draw resistance of about 180 to 200 mm of WC, but the hardness diminishes, corresponding to a depth of penetration of about 0.55 to 0.70 mm, as shown in FIG. 10. This softness of filter rods produced from paper webs "knurled" in this way is regarded as a disadvantage during further processing of these rods, but hitherto no other method for achieving the desired increase in the draw resistance was known.

Hardness measurement G: The longitudinally grooved paper web described in Example E was additionally passed, in the dry state between two smooth cylindrical rollers which rotated about parallel horizontal axes and the gap between which had been narrowed to a slit of 0.1 to 0.2 mm. This pressing equipment has already been described in the U.S. Pat. No. 3,383,852 as a means of increasing the draw resistance of filter rods produced from paper webs "flattened" in this way. It is possible to manufacture filter rods having a draw resistance of 190 to 210 mm of WC from the paper webs of Example E prepared in this way, but these rods have a greatly reduced hardness corresponding to the depth of penetration of 0.84 to 1.04 mm indicated in FIG. 10. Filter rods which have such poor mechanical hardness values are difficult to use in further processing.

Thus, the present process is the only method known hitherto for altering the structure of paper webs having closely adjacent zones which extend in the longitudinal direction and have a highly fibrillated and weakened structure, as well as zones, located between the former zones, having rib-like deformations, so that a substantial increase in the draw resistance of filter rods manufactured therefrom is obtained with virtually no reduction, or only a slight and tolerable reduction, in the mechanical hardness of these filter rods.

The paper webs described above for the filter rods according to Examples B and D and also the paper webs shown in FIGS. 6 and 7 were all treated in accordance with the present process using equipment corresponding to FIG. 5. For this treatment, a roller 13 with ribs 17 running parallel to the axis of the roller and extending over its entire length was used. The surface of the roller 13 is shown schematically in FIG. 11. However, for the present process and the advantages, described above, of the correspondingly processed paper web, it is not necessary for the ribs to extend without interruption over the entire length of the roller. On the contrary, it is possible, to use a roller according to FIG. 12 with which each of the individual ribs has interruptions. However, a requirement is that these interruptions in the individual ribs are not all at the same point but that the gaps mutually overlap, so that the required homogeneity of the paper web in respect of the indentations running transversely to the longitudinal ribs is ensured.

Figures 11, 12, 13, 14, 15:
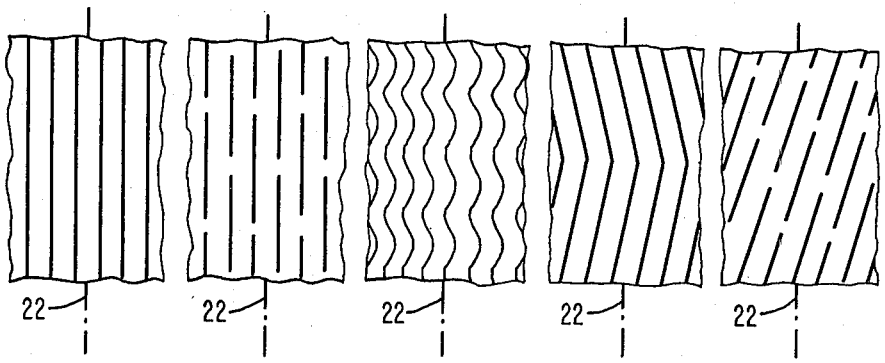

In the embossing rollers according to FIGS. 11 and 12, all of the ribs run parallel to the axis 22. This is not absolutely essential for the present purpose; on the contrary it suffices if the ribs are aligned at least approximately parallel to the axis of the rollers and, therefore, embossing rollers according to FIG. 13, which have ribs corresponding to a wavy line, can be used. Ribs which slope slightly towards the axis of the roller are also admissible, as shown in FIGS. 14 or 15. However, in all forms of such embossing rollers it is important that the direction of the ribs deviates only relatively slightly from that of the axis 22 of the rollers, since it is important that the indentations in the form of lines or strokes in the rib-like deformations, running in the longitudinal direction, of the paper web are aligned transversely to the longitudinal zones because it is only then, after the paper web has been gathered together to form a cylindrical filter rod, that these indentations assist in maintaining a certain rigidity of the packing in the radial direction, which prevents a reduction in the mechanical hardness of such filter rods.

When designing the embossing rollers for the present process, it is important that the longitudinally grooved paper web provided with indentations running transversely ensures homogeneous packing of the filter rods or of the filter plugs formed therefrom by subdividing. Since, for some applications, for example in the case of so-called double or triple filters, the filter rods are subdivided into relatively short filter plugs having an axial length of only 5 to 6 mm, care must be taken to ensure adequate homogeneity of the packing even in these short filter plug sections. Because of this demand, it is a condition that the indentations in the form of lines or strokes which are embossed transversely into the paper web are arranged relatively closely behind one another in the axial direction, so that at least two or more such indentations are present even in the above mentioned short filter plug sections. A distance between successive indentations in the axial direction of about 1.5 to 2 mm has proved to be appropriate, so that even a short filter section only 5 to 6 mm in length contains at least two to three of these indentations running transversely. If the distance between successive indentations were to be greater than 2 mm, it could happen, as can be seen from FIG. 8, that, in a short filter piece only 6 mm in length, the packing has two or only one of these indentations, which could result in considerable divergencies in the draw resistance from one filter to another. It is also appropriate to make the cross-section of the individual rib 17 in an embossing roller 13 of this type relatively narrow, so that the tip of these ribs does not have a width greater than about 0.2 to 0.3 mm, even after the embossing roller has been ground. In this way it is ensured that the indentations running transversely in the axial direction of the filter stick have a width which is small compared with the distance between two successive indentations, as can be seen from FIG. 8.

In FIGS. 1 and 5, the ribs 17 and 18 respectively are drawn with flat and sharp-edged tips. This embodiment is advantageous because it is then possible to grind the surface of each of the finished embossing rollers coaxially to its axis of rotation before it is installed in the particular embossing station, in order to ensure that the distance of 0.15 to 0.20 mm between opposite tips of the ribs 17 and 18 (FIG. 1), or between the tips of rib 17 and the opposite cylindrical surface 21 (FIG. 5), which is required for the present process, is maintained even when the two interacting rollers are rotated. If even only one of the two rollers were to be untrue by more than 0.01 mm relative to its central axis, this would result, because of the changing gap width between the two rollers during one revolution of the particular roller, in indentations of varying depth in the paper web, and this would result in corresponding differences in the draw resistance of the filter rods manufactured therefrom. In practice, a means of checking that the two interacting rollers of an embossing station of this type run true is first to provide a thin metal foil or a metalised paper web with corresponding longitudinal grooving and then to pass the foil or web through the gap between the two interacting rollers, since the design produced by the indentations on the web surface can then be clearly seen on the surface of a material web of this type and can be checked in respect of uniformity.

The rollers provided with ribs on the surface, which are used in the present process, can usually be manufactured be milling the desired design of ribs into a roller having a smooth surface. Since, however, embossing rollers of this type are subject to a certain wear in operation and have to be replaced after the surface has been ground several times, since the width of the particular tips of the ribs becomes greater after every grinding, an embodiment of the embossing rollers according to FIG. 16 and 17 has proved useful. In this case, the embossing roller consists of a thick-walled tube 23, onto which individual rings 24 are pushed, the rings being secured against movement in the direction of the axis 22 by a stop ring 25 at each end of the carrier tube 23. The surfaces of the individual ring 24 are provided with the particular desired rib design and can be exchanged relatively easily and replaced when worn without the carrier tube 23 and its bearings having to be replaced. An embossing roller of the construction shown in FIGS. 16 and 17 is, however, suitale only for an illustrative embodiment of the embossing station according to FIG. 5, in which it interacts with a cylindrical roller having a smooth surface. This is because it is then immaterial whether the surface designs on consecutive rings 24 coincide or are out of phase with one another. Of course, it is also necessary to grind over the surface of an embossing roller provided with embossing rings 24 of this type after the roller has been assembled, and for this purpose it suffices mutually to secure the individual rings against twisting by axial pins with holes of appropriate size on the sides of the rings which face towards one another. It is possible to manufacture the embossing rings 24 on conventional machine tools without difficulty and an embossing roller of the construction shown in FIGS. 16 and 17 is cheaper both to manufacture and to maintain in continuous operation than is an embossing roller consisting of only one piece.

In an embossing station for carrying out the present process it can be appropriate, as will also be explained further below, to provide heating for the embossing rollers. Accordingly, in the illustrative embodiment of the embossing rollers according to FIGS. 16 and 17, the grooves 26 are provided in the jacket of the carrier tube 23 parallel to the axis 22 of the roller, these grooves holding appropriate electrical heating elements 27. These heating elements 27 are then connected, in operation, via rotating slip rings and stationary brushes with a corresponding current source, which appropriately can be regulated. If desired, however, a carrier roller of this type can also be heated by providing electrical heating elements in the inner space of the carrier tube 23, which elements do not rotate with the tube and can then be connected via a hollow axle supporting the embossing roller for rotation. It is also possible to provide internal heating of this type using other means, thus, for example, using super heated steam or gas.

According to the present process, fibre-containing material webs, and especially paper webs which have a multiplcity of zones running in the longitudinal direction and having a highly fibrillated structure and/or unconnected orifices, and also zones, located between the former zones, having a denser structure and/or rib-like deformations, can be considerably improved so that filter rods manufactured therefrom have more advantageous properties. Paper webs of the said type, wound to give so-called coils about 90 cm in diameter and at most 30 cm in width, are known and are supplied to filter factories or cigarette manufacturers for use in the manufacture of filter rods. The installations according to FIGS. 18 and 19 can serve to improve coils of this type in accordance with the present process.

In the installation shown schematically in FIG. 18, the longitudinally grooved paper web 31, which is to be treated, is drawn off from the particular coil 30 and fed through an apparatus 33 before it is fed to the embossing station 34. The apparatus 33 serves to condition the paper web 31, that is to say either to remove moisture from the paper if this has too high a water content, or slightly to moisten the paper web if this should be too dry. Since, in some cases, for example when transported by sea or when stored in a tropical climate, the coils 30 tend, because of their high absorbency, to undergo a rise in the moisture content of the paper, a drying installation 33 is appropriate in some cases. It can then also be desirable to warm the interacting rollers 35 and 36 of the embossing station 34, as has already been described above. On the other hand, it has been found that in some cases long term storage of coils 30 in a dry store room effect too great a drying out of the paper web 31, so that it is then appropriate to moisten the paper web somewhat as it passes through the apparatus 33, for example by spraying with a fine spray of water or by other known means.

The embossing station 34 contains the two interacting rollers 35 and 36, of which, for example, the roller 35 is provided as the embossing roller and has ribs on its surface, while roller 36 has a smooth cylindrical surface. The embossing station 34 is arranged in such a manner that the distance between the rollers 35 and 36 can be precisely and reproducibly set, for example by an arrangement in which the bearings of the roller 35 are supported in sliding guides in the holding frame in the embossing station 34 and can be raised or lowered using fine-threaded screws. The two rollers are jointly set in rotary motion by the drive 37 and specifically are set in motion so that the surface speed of the roller 36 precisely corresponds to the speed of the tips of the ribs on the roller 35. It must be possible to regulate the drive 37 so that the desired throughput speed for the paper web 31 can be set. In the case of paper webs of the type described above with the aid of Examples A to D, a throughput speed of the paper web 31 of up to 250 m/minute is possible without difficulty. If necessary, however, the speed can be raised to more than 400 m/minute. At these speeds it may be appropriate to provide the shaft for the run-off of the coil 30 with a braking device of the type customary in the paper industry.

The paper web which issues from the embossing station 34 and which now has a design of closely adjacent impressions in the form of lines or strokes which extend transversely over at least part of the longitudinal zones, so that, in particular, the rib-like deformations running in the longitudinal direction have successive indentations in the longitudinal direction, subsequently passes to a wind-up unit 38 where it is wound up, after passing beneath the guide roller 39, in the direction of the arrow to give a coil 40. The wind-up unit 38 is connected via the shaft 41 to the drive 37 and can be of known construction, so that a more detailed description is not necessary. An advantage of the paper web 31 which issues from the embossing station 34, that is to say a paper web processed in accordance with the present process, is that the embossed design in no way effects a reduction, but rather effects an increase, in the mechanical tear strength of the paper web in both the longitudinal and the transverse direction. Accordingly, it is possible without difficulty to wind up the paper web, processed in this way, at high speed to give a coil 40, which can then be supplied to the consumers, and there further processed, in the same way as indicated above in respect of the coil 30.

In the installation shown schematically in FIG. 19, the paper web 31 is fed to the embossing station 34 in the same way as described above but in this case the embossing station is provided with a drive 41 which can be controlled electronically. The paper web which issues from the embossing station 34 is first fed past the guide roller 42 to the tension measuring device 43 and passes from here directly into the feed funnel 44 of a tow machine 45 of conventional construction for the direct manufacture of filter rods. In the tension measuring device 43, which is indicated only schematically, the longitudinal tension of the paper web passing through is monitered in a known manner, for example by means of a balance arm which has two deflection pulleys at the end and which can be turned to a greater or lesser extent in the indicated direction of the arrow depending on the actual tension of the paper web passing over the deflection pulleys. Such devices are generally known and do not need to be described in more detail. Depending on the degree to which the particular balance arm is turned, an electrical correction signal is fed from this tension measuring device 43 via the line 46 to the drive 41, where it is used to change the drive speed for the embossing station 34 until the throughput speed of the paper web corresponds to that through the tow machine 45. The drive of this tow machine 45 is connected, for example, to a tacho generator, which supplies a signal via line 47 to the drive 41, where this signal is compared with a signal from a similar tacho generator fitted to the embossing station 34. Electronically controlled drives 41 of this type are generally known and do not need to be described in more detail. The signals on lines 46 and 47 and also the tension measuring device 43 ensure that the embossing station 34 and the tow machine 45 work synchronously, that is to say that the paper web 31 passes at a constant speed and with a constant longitudinal tension through the embossing station 34 and the tow machine 45.

It should be pointed out that even when commercially available tow machines 45 are used, the paper web 31 is gathered together, when it runs into the funnel 44, in a completely irregular manner in the transverse direction to give a cylindrical tow which, after it has been covered with a paper tape, is subdivided into filter rods. Despite this deliberate gathering together, each filter rod has a highly homogeneous packing, as can be seen, for example, from FIG. 8, which shows a filter rod which was manufactured using a tow machine of this type with a speed of the paper web of more than 200 m/minute. This homogeneous packing results not only in very slight divergencies in the draw resistance of such filter rods but also, after the filter rods have been subdivided into filter plugs, in a good appearance of the cut at the end surface without undesired large pores being visible.

The installations according to FIGS. 20 and 21 can also advantageously be used to manufacture the material webs having a design of adjacent impressions in the form of lines or strokes extending transversely over at least part of the longitudinal zones and having successive indentations in the longitudinal direction, especially in the rib-like deformations of the paper web. In this case, for example, a smooth paper web weighing 30–40 grams/m$^2$ is used as the starting material and, depending on the grooved paper webs, provided with indentations, to be manufactured, this web has a width of about 20–30 cm. Smooth paper webs of this type used as starting materials are designated as raw paper and are commercially available in the form of raw paper rolls, usually having a diameter of 70–90 cm.

In the installation according to FIG. 20, the smooth paper web 51 is withdrawn from a raw paper roll 50 and passes first through a moistening installation, consisting, in this case, for example of a water bath 52, in which a rotating roller 53 is partially immersed. The thin film of water adhering to the surface of this roller 53 suffices to moisten the paper web 51 which is pressed against this surface by means of a roller 54 made of elastic material, for example of rubber. The moistened raw paper web then passes to a so-called grooving or longitudinal creping station consisting of the three driven rollers 55, 56 and 57. A creping station of this type is described in detail in the U.S. Pat. No. 3,466,358. Each of the creping rollers 55, 56 and 57, which are made of metal, has on its surface a multiplicity of annular ribs which are arranged close to one another and have an approximately rectangular cross-section and a width of about 0.3 mm, the distance between consecutive ribs being, for example, 0.7 mm. The lower roller 55 and the upper creping roller 57 can be finely adjusted in respect of their distance from the central creping roller 56, so that the annular ribs of the lower and the upper creping roller in each case engage in the grooves between adjacent annular ribs of the central creping roller 56 without the side flanks of the annular ribs engaging with one another coming into contact with one another. As is indicated schematically in FIG. 20, the moistened, and therefore pliable, paper web first passes into the slit between the creping rollers 55 and 56, then remains in contact with the fore-parts of the annular ribs of creping roller 56 for the period of half a revolution and is subsequently taken over by the tips of the annular ribs of creping roller 56 for the period of half a revolution and subsequently taken over by the tips of the annular ribs of creping roller 57 and withdrawn via the deflection pulley 58. The paper web 59 issuing from this grooving station containing the creping rollers 55, 56 and 57 then has a multiplicity of zones which run in the longitudinal direction and have a highly fibrillated structure and/or unconnected crack-like orifices, and also has zones, located between the former zones, having a denser structure and/or rib-like deformations, the structure being determined by the adjustable depth to which the creping rollers 55 and 57 engage in the central creping roller 56. The paper web structured in this way, which is still moist, is then fed via the guide roll 60 to a drying installation 61, in which the moisture content of the paper web is virtually completely eliminated. The dry paper web then passes into an embossing station 34 which contains the interacting rollers 35 and 36, as has already been explained in more detail above with the aid of FIG. 18. A drive 63 is provided for rotating the rollers 53 and 54 of the moistening station, but this drive is connected to the drive 64 of the creping rollers 55, 56 and 57 and to the drive 65 of the embossing rollers 35 and 36 and ensures that the paper web 51 is always under a slight tension in the longitudinal direction.

The paper web 62 which issues from the embossing station and has been provided with a design consisting of closely adjacent impressions and successive indentations in the longitudinal direction can either be wound up to coils or further processed direct to filter rods. In the first mentioned case, the paper web 62 is fed to a wind-up unit 38 of the type already described above for the installation according to FIG. 18. This wind-up unit 38 is coupled via a shaft to the drives 65, 64 and 63.

Since, according to experience, a relatively large number of coils 40 can be produced from a raw paper roll 50 using a wind-up unit 38, this wind-up unit 38 is in the present case appropriately to be so designed that it is possible, after the production of a coil 40, to remove this coil and to continue winding up the next coil without the advancing movement of the paper web 62 being interrupted or it being necessary to reduce the operating speed of the installation according to FIG. 20. Wind-up apparatuses of this type are known and do not need to be described in any more detail. On the other hand, however, it is also possible to process the paper web 62 which issues from the embossing station 34 direct to filter rods and for this purpose the paper web is fed, via an interconnected tension measuring device 43, of the type described above with the aid of FIG. 19, direct to the feed funnel 44 of a tow machine 45 of conventional construction. In this case also provision must be made, as explained above with the aid of FIG. 19, for synchronisation between the tow machine 45 and the drive parts 63, 64 and 65 of the installation according to FIG. 20.

A preferred illustrative embodiment of an installation for the manufacture of a paper web is shown in FIG. 21, and this installation is also intended for processing a raw paper roll 50. In this case, however, it is necessary to use a raw paper which can be processed in a longitudinal grooving and creping station consisting of the creping rollers 55, 56 and 57 without prior moistening. Raw papers of this type are commercially available and, after passing through the creping station, can be fed direct to an embossing station 34 containing the embossing rollers 35 and 36, where they are provided with an embossed design and a multiplicity of successive indentations in the longitudinal direction, as has been described above with the aid of FIGS. 18 and 19. In a manner similar to that shown in FIG. 19, the paper web issuing from the embossing station 34 is here fed via a guide roll 42 and via an interconnected tension measuring device 43 direct to the feed funnel 44 of a tow machine 45 of conventional construction. Since the raw paper web 51 is not moistened, a drying apparatus of the type used in the installation according to FIG. 20 is also not necessary. If desired, an electronic control device 66 for synchronisation between the drive of the tow machine 45 and the drives 64 and 65 can be provided. In an installation corresponding to FIG. 21, very high throughput speeds can be achieved for the paper web 51 and the maximum production capacity of the tow machine 45 which is used can be fully utilised. Speeds of the paper web of 400 m/minute and more have already been achieved in operation.

When the paper web produced in the installations according to FIG. 19 and FIG. 21 is processed immediately in a conventional tow machine, the possibility also exists of providing the particular tow machine with a correspondingly more powerful drive and of mechanically coupling the apparatuses, to be driven, of the installation according to FIG. 19 or FIG. 21, to the drive of the tow machine. It is then necessary merely to provide commercially available and adjustable gearings between the drive shafts and the corresponding stations, such as those available commercially, for example, under the name VIP control gears.

In the installations according to FIGS. 20 and 21, it can be advantageous to provide both the creping rollers 55, 56 and 57 and the embossing rollers 35 and 36 with heating, as, for example, has already been described above with the aid of FIGS. 16 and 17. The longitudinal grooving and creping stations which consist of three rollers as (and are of the type) indicated in the installations according to FIGS. 20 and 21 are indeed advantageous but can also be replaced by corresponding stations of simpler construction in which, in each case, the upper roller 57 is omitted and the paper web 51 is passed only through the slit between the creping rollers 55 and 56 and behind these is withdrawn directly from the creping station, so that the deflection rolls 58 and 60 are omitted. Simpler grooving and creping stations of this type consisting of only two rollers are especially advantageous when it is not necessary to provide particularly deep grooving and rib-like deformations in the particular paper webs.

A check was also carried out on the filter rods, manufactured in accordance with the Examples A to D illustrated above in order to determine whether the homogeneity of the packing of such filter rods is influenced in any way by the impressions and indentations produced according to the present process. For this purpose, when manufacturing the filter rods in each case 100 pieces from the exit of the particular tow machine were numbered in sequence and examined to determine the draw resistance. It was found that the deviations of the draw resistance from the average value thereof were less than ±5%, which was within the limits of tolerance usually demanded for such filter rods. It is significant that 8.1×66 mm filter rods of the above mentioned Examples C and D weighing about 65 grams per 100 pieces and having a draw resistance of 340 mm of WC ±5% could not be manufactured hitherto from paper webs by other means without the hardness showing inadmissibly low values.

In the above mentioned illustrative embodiments, the material webs, the process for their treatment and their use has been explained in particular with the aid of suitable paper webs. However, it should be pointed out that it is also possible to use, in place of these paper webs, flat and paper-like fibre webs of a different composition if these are suitable for provision with corresponding structures in the longitudinal direction and for receiving an embossed design consisting of impressions running transversely and successive indentations in the longitudinal direction.

We claim:

1. A process for treating a web of fibrous material to improve its filtering qualities and increase its resistance to lateral crushing when gathered transversely and enclosed in a wrapper to make a filter cord subdividable into filter rods and filter plugs for cigarettes, the web being provided with closely spaced longitudinal corrugations wherein the material has been laterally stretched to loosen and expose fibers, comprising:

advancing the web along a path; and compressing and compacting the advancing web in successive spaced narrow transverse zones to substantially eliminate the corrugations and produce a denser structure in said zones, said zones being of a width not over about 0.4 mm and of a thickness of the order of about 0.2 mm and being spaced apart not over about 2.0 mm.

2. The process defined in claim 1 in which the web prior to being provided with the longitudinal corrugations is smooth and has a weight of the order of between 30 and 40 grams/m$^2$.

3. The process defined in claim 1 wherein the web is compressed by exerting pressure simultaneously against its opposite sides.

4. The process defined in claim 3 in which the web is compressed by advancing it between the bight of a pair of embossing rolls provided with circumferentially-spaced ribs generally transverse to the direction of advance and driven in synchronism so that when a rib on one roll is in said bight, a rib on the other is substantially opposed thereto.

5. The process defined in claim 1 wherein the web is compressed by exerting pressure against only one side thereof while the opposite side is backed by an uninterrupted smooth substrate.

6. The process defined in claim 5 in which the web is compacted by advancing it through the bight between two embossing rolls, one smooth surfaced and the other provided with circumferentially-spaced ribs generally transverse to the direction of advance.

7. The process defined in claim 1 wherein the compressing step is performed by passing the web material through the bight between a pair of driven embossing rolls and including the steps of:

drawing the web from a supply roll prior to the compressing step;

feeding the compressed web directly to a filter cord-making machine; and adjusting the speed of the embossing rolls to advance the web at the same speed at which it advances through the machine.

8. The process defined in claim 7 including the step of adjusting the moisture content of the web after it is drawn from the supply roll and prior to the compressing step.

* * * * *